US007232383B2

(12) United States Patent
Kato et al.

(10) Patent No.: US 7,232,383 B2
(45) Date of Patent: Jun. 19, 2007

(54) THREE-PIECE SOLID GOLF BALL

(75) Inventors: Akira Kato, Kobe (JP); Takahiro Sajima, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 26 days.

(21) Appl. No.: 10/419,751

(22) Filed: Apr. 22, 2003

(65) Prior Publication Data

US 2003/0211902 A1 Nov. 13, 2003

(30) Foreign Application Priority Data

May 8, 2002 (JP) ..... 2002-132920

(51) Int. Cl.
*A63B 37/04* (2006.01)
*A63B 37/06* (2006.01)
*A63B 37/12* (2006.01)
*A63B 37/14* (2006.01)

(52) U.S. Cl. ..... 473/371; 473/378; 473/383

(58) Field of Classification Search ..... 473/351–385
See application file for complete search history.

(56) References Cited

U.S. PATENT DOCUMENTS 4,429,068 A * 1/1984 Nakahira ..... 524/302
4,714,253 A * 12/1987 Nakahara et al. ..... 473/373
5,072,944 A * 12/1991 Nakahara et al. ..... 473/373
5,711,723 A 1/1998 Hiraoka et al.
5,720,676 A * 2/1998 Shimosaka et al. ..... 473/384
5,830,085 A 11/1998 Higuchi et al.
5,836,832 A * 11/1998 Boehm et al. ..... 473/354
6,200,232 B1 * 3/2001 Kasashima et al. ..... 473/384
6,248,029 B1 6/2001 Maruko
2003/0008729 A1 * 1/2003 Sajima ..... 473/378

FOREIGN PATENT DOCUMENTS

JP 8-332247 A 12/1996
JP 9-313643 A 12/1997
JP 11-151320 A 6/1999

OTHER PUBLICATIONS

"Ionomer", Efunda Engineering Fudamentals. copyright 2001.*

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

The present invention provides a three-piece solid golf ball having long flight distance by accomplishing low spin amount and high launch angle at the time of hitting, while maintaining good shot feel. The present invention relates to a three-piece solid golf ball comprising a core composed of a center and an intermediate layer formed on the center, and a cover covering the core and having many dimples on the surface thereof, wherein the center has a diameter of 10 to 20 mm and a central point hardness in JIS-A hardness of 20 to 90, the intermediate layer has a surface hardness in Shore D hardness of 50 to 65, and the cover has a Shore D hardness of 55 to 70, a flexural modulus of not less than 280 MPa and a thickness of 0.5 to 2.5 mm.

9 Claims, 1 Drawing Sheet

THREE-PIECE SOLID GOLF BALL

This nonprovisional application claims priority under 35 U.S.C. § 119(a) on patent application No(s). 2002-132920 filed in JAPAN on May 8, 2002, which is(are) herein incorporated by reference.

FIELD OF THE INVENTION

The present invention relates to a three-piece solid golf ball. More particularly, it relates to a three-piece solid golf ball having long flight distance by accomplishing low spin amount and high launch angle at the time of hitting, while maintaining good shot feel.

BACKGROUND OF THE INVENTION

Solid golf balls, which have good rebound characteristics and small spin amount, are generally approved of or employed by most of general amateur golfers, who regard flight distance as most important characteristics of golf ball. On the other hand, professional golfers and high level golfers regard controllability as most important, followed by soft and good shot feel, and flight performance. Therefore they have mainly employed thread wound golf balls, because they regard controllability as most important and the golf ball has soft and good shot feel. However, it is problem that the thread wound golf ball has a structure, which is easy to apply spin, and it has high spin amount when hit by every golf club, which degrades the flight performance. In order to solve the problem, many solid golf balls, of which the shot feel and flight performance are improved while maintaining good controllability, have been proposed (Japanese Patent Kokai Publication Nos. 332247/1996, 313643/1997, 151320/1999 and the like).

In Japanese Patent Kokai Publications No. 332247/1996, a three-piece solid golf ball which comprises a two-layer structured core composed of an inner core and outer core, and a cover is described. The inner core has a diameter of 25 to 37 mm, has a center hardness in JIS-C hardness of 60 to 85 and has a hardness difference from the center of the inner core to the surface of the inner core is within the range of not more than 4, the outer core has a surface hardness in JIS-C hardness of 75 to 90, and the cover has a flexural modulus of 1,200 to 3,600 kg/cm$^2$. However, since the center hardness of the inner core (center) is high, low spin amount is not sufficiently accomplished when hit by a middle iron club to driver, and the flight distance is not sufficiently obtained.

In Japanese Patent Kokai Publications No. 313643/1997, a three-piece solid golf ball, of which an intermediate layer formed from thermoplastic resin is placed between a core and a cover is described. The core has a center hardness in JIS-C hardness of not more than 75 and has a surface hardness in JIS-C hardness of not more than 85, the surface hardness is higher than the center hardness by 5 to 25, a hardness of the intermediate layer is higher than the surface hardness of the core by less than 10, and a hardness of the cover is higher than the hardness of the intermediate layer. However, since the intermediate layer is formed from thermoplastic resin, it is problem that the rebound characteristics are degraded and the shot feel is hard and poor.

In Japanese Patent Kokai Publication No. 151320/1999, a three-piece solid golf ball which comprises a two-layer structured core composed of an inner core and outer core, and a cover is described. The inner core has a diameter of 15 to 22 mm and Shore D hardness of 40 to 70, the outer core has a JIS-C hardness of 40 to 75, the inner core and outer core are formed from rubber composition, and the cover has a thickness of 0.5 to 3 mm. However, since the center hardness of the inner core (center) is high, low spin amount is not sufficiently accomplished when hit by a middle iron club to driver, and the flight distance is not sufficiently obtained.

In the golf balls described above, since hard and large center is used, the deformation amount at the time of hitting of the golf ball is small, and the spin amount is large and the launch angle is small. Therefore, the flight distance is not sufficiently obtained. In addition, if the flight distance will be improved, shot feel is hard or heavy, and poor. Therefore, a golf ball having sufficient performances has not been obtained.

OBJECTS OF THE INVENTION

A main object of the present invention is to provide a three-piece solid golf ball having long flight distance by accomplishing low spin amount and high launch angle at the time of hitting, while maintaining good shot feel.

According to the present invention, the object described above has been accomplished by providing a three-piece solid golf ball comprising a core having a two-layered structure, which is composed of a center and an intermediate layer, and a cover, and adjusting a diameter and central point hardness of the center; a surface hardness of the intermediate layer; and a hardness, flexural modulus and thickness of the cover to specified ranges, thereby providing a three-piece solid golf ball having long flight distance by accomplishing low spin amount and high launch angle at the time of hitting, while maintaining good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
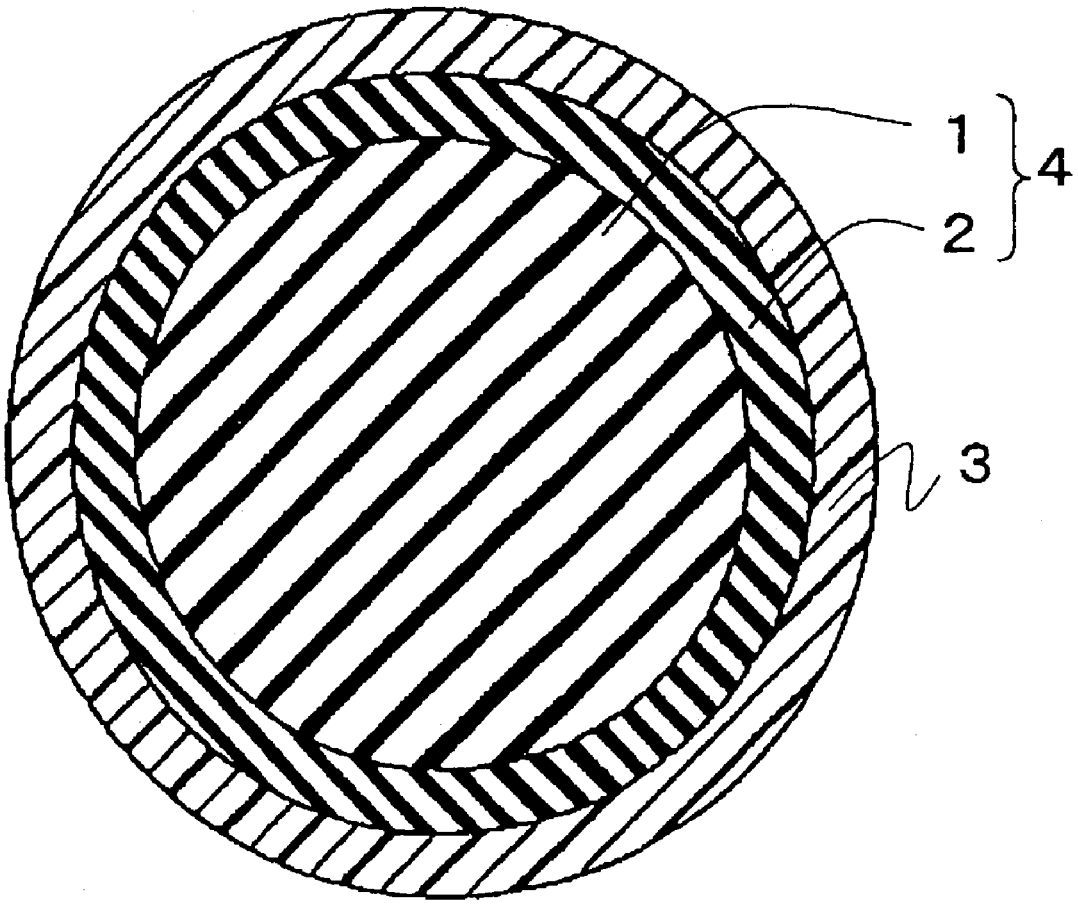
FIG. 1 is a schematic cross section illustrating one embodiment of the golf ball of the present invention.

The present invention provides a three-piece solid golf ball comprising a core composed of a center and an intermediate layer formed on the center, and a cover covering the core and having many dimples on the surface thereof, wherein

- the center has a diameter of 10 to 20 mm and a central point hardness in JIS-A hardness of 20 to 90,
- the intermediate layer has a surface hardness in Shore D hardness of 50 to 65, and
- the cover has a Shore D hardness of 55 to 70, a flexural modulus of not less than 280 MPa and a thickness of 0.5 to 2.5 mm.

In the conventional three-piece golf ball, since a center harder than that of the present invention is used, it is required to use a material harder than the center as a intermediate layer when a diameter of the center is small, and the resulting golf ball is hard. Therefore, a diameter of the center, which is large, is within the range of 25 to 41 mm.

A deformation amount of the golf ball when hit by a middle iron club to a driver is small and the spin amount is large, and the flight distance is not sufficiently obtained. There has been golf balls having small diameter of the center, but the target therefor is a player who swings the golf club at low head speed, and then the deformation amount when hit at low head speed is large. Therefore, the hardness of the intermediate layer is low and the central point hardness of the center is high, and the spin amount when hit by a middle iron club to a driver is large, which reduces the flight distance. Since the hardness of the intermediate layer is low, the rebound characteristics are not sufficiently obtained, which reduces the flight distance. In addition, the shot feel is poor such that the rebound characteristics are poor.

The present inventors have developed a three-piece solid golf ball in different point of view from the conventional point, which the hardness at the distance of 5 to 10 mm from the central point of the center has great effect on the restraint of the spin amount when hit by a middle iron club to a driver. Thereby the three-piece solid golf ball is accomplished by decreasing the diameter and hardness of the center, of which the spin amount is small and the launch angle is large at the time of hitting to improve the flight distance.

In order to put the present invention into a more suitable practical application, it is desired that

- the center and intermediate layer be formed from a vulcanized molded article of a polybutadiene rubber composition;
- the center be formed from a vulcanized molded article of a silicone rubber composition, and the intermediate layer be formed from a vulcanized molded article of a polybutadiene rubber composition;
- the cover be formed from a cover composition mainly comprising ionomer resin as a base resin; and
- a ratio of the golf ball surface area occupied by the dimple to the total surface area of the golf ball be not less than 75%, total number of the dimples be not more than 320 and the maximum diameter of the dimple be from 11 to 18% of the diameter of the golf ball.

DETAILED DESCRIPTION OF THE INVENTION

The three-piece solid golf ball of the present invention will be explained with reference to the accompanying drawing in detail. FIG. 1 is a schematic cross section illustrating one embodiment of the three-piece-solid golf ball of the present invention. As shown in FIG. 1, the golf ball of the present invention comprises a core 4 consisting of a center 1 and an intermediate layer 2 formed on the center 1, and a cover 3 covering the core 4. The core 4, including both the center 1 and the intermediate layer 2, is obtained by press-molding a rubber composition under applied heat.

In the golf ball of the present invention, it is required for the center 1 to have a diameter of 10 to 20 mm, preferably 12 to 19 mm, more preferably 14 to 16 mm. When the diameter of the center 1 is smaller than 10 mm, the spin amount at the time of hitting is increased, and the hit golf ball creates blown-up trajectory, which reduces the flight distance. On the other hand, when the diameter is larger than 20 mm, the resulting golf ball is too soft, and the desired hardness is not obtained, which degrades the rebound characteristics. In addition, the shot feel is poor such that the rebound characteristics are poor.

In the golf ball of the present invention, it is required for the center 1 to have a central point hardness in JIS-A hardness of 20 to 90, preferably 25 to 85, more preferably 30 to 80, most preferably 35 to 75. When the central point hardness of the center 1 is lower than 20, the rebound characteristics of the center are degraded, and the rebound characteristics of the resulting golf ball are degraded, which reduces the flight distance. On the other hand, when the central point hardness is higher than 90, the technical effects of restraining the spin amount at the time of hitting are not sufficiently obtained. In addition, the shot feel is hard and poor. The term "a central point hardness of the center 1" as used herein refers to the hardness, which is obtained by cutting the center into two equal parts and then measuring a hardness at the central point in section.

In the golf ball of the present invention, it is desired for the center 1 to have a surface hardness in JIS-A hardness of 20 to 95, preferably 25 to 90, more preferably 30 to 85. When the surface hardness of the center 1 is lower than 20, the rebound characteristics of the center is too low, and the rebound characteristics of the resulting golf ball are degraded, which reduces the flight distance. On the other hand, when the surface hardness of the center 1 is higher than 95, the center is too hard, and the shot feel of the resulting golf ball is poor. In addition, the technical effects of restraining the spin amount at the time of hitting are not sufficiently obtained. The term "a surface hardness of the center 1" as used herein refers to the hardness, which is determined by measuring a hardness at the surface of the resulting center.

In the golf ball of the present invention, a material for the center 1 is not limited as long as it has properties as described above, but it is desired for the center 1 to be formed from a vulcanized molded article of a rubber composition, such as a polybutadiene rubber composition, a silicone rubber composition and the like. Preferred is silicone rubber composition because a rubber-molded article, which is soft and has high rebound characteristics, is easily obtained.

The polybutadiene rubber composition for the center 1 may be rubber composition mainly comprising polybutadiene rubber, which have been conventionally used for preparing the core of solid golf balls, and contains

- from 3 to 20 parts by weight, preferably from 5 to 18 parts by weight of a co-crosslinking agent,
- from 0.5 to 5 parts by weight, preferably from 0.7 to 4 parts by weight of an organic peroxide,
- from 10 to 30 parts by weight, preferably from 12 to 25 parts by weight of a filler and the like, based on 100 parts by weight of polybutadiene rubber.

The preferred polybutadiene rubber is high-cis polybutadiene rubber containing a cis-1, 4-bond of not less than 40%, preferably not less than 80%, which has been conventionally used for cores of solid golf balls. The high-cis polybutadiene rubber may be optionally mixed with natural rubber, polyisoprene rubber, styrene-butadiene rubber, ethylene-propylene-diene rubber (EPDM) and the like.

The co-crosslinking agent can be $\alpha,\beta$-unsaturated carboxylic acids having 3 to 8 carbon atoms (e.g. acrylic acid, methacrylic acid, etc.) or a metal salt thereof, including mono or divalent metal salts, such as zinc or magnesium salts; a functional monomer such as trimethylolpropane trimethacrylate; or mixtures thereof. The preferred co-crosslinking agent is zinc acrylate because it imparts high rebound characteristics to the resulting golf ball. When the amount of the co-crosslinking agent is too small, the core is too soft, and the rebound characteristics of the resulting golf ball are degraded, which reduces the flight distance. In addition, since the cover is formed from soft material, the resulting golf ball is too soft, and the shot feel is poor. On the other hand, when the amount of the co-crosslinking agent is too large, the core is too hard, and the shot feel is poor.

The organic peroxide, which acts as crosslinking initiator, includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. When the amount of the organic peroxide is too small, the core is too soft, and the rebound characteristics are degraded, which reduces the flight distance. On the other hand, when the amount of the organic peroxide is too large, the core is too hard, and the shot feel is poor.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. When the amount of the filler is too small, it is required to add a large amount of filler to the cover in order to adjust the weight of the resulting golf ball to a proper range. Therefore the rebound characteristics of the resulting golf ball are degraded. On the other hand, when the amount of the filler is too large, the weight of the core is too large, and it is difficult to adjust the weight of the resulting golf ball to a proper range.

The polybutadiene rubber compositions for the center 1 of the golf ball of the present invention can optionally contain other components, which have been conventionally used for preparing the core of solid golf balls, such as organic sulfide compound, antioxidant and the like. If used, the amount of the other components is from 0.5 to 5.0 parts by weight, preferably 0.7 to 4.0 parts by weight, based on 100 parts by weight of the base rubber.

The center 1 used in the golf ball of the present invention is obtained by uniformly mixing the above rubber composition, and then vulcanizing and press-molding the mixture in a mold. The vulcanization may be conducted, for example, by press molding in a mold at 130 to 180° C. and 2.9 to 9.8 MPa for 15 to 60 minutes.

The silicone rubber composition for the center 1 is obtained by dispersing filler, vulcanization agent and the like in raw silicone rubber. The raw silicone rubber, which is colorless elastic body slightly flowable at room temperature, contains dimethyl siloxane unit $[(CH_3)_2SiO]$ as a main component, contains 103 diorganosiloxane units per a molecular on an average, and has an average molecular weight of about $10^5$ to $10^6$. The raw silicone rubber is formed by ring opening polymerization of cyclic dimethyl siloxane, which is formed by hydrolyzing dimethyl dichloro silane, with acid or alkali under applied heat. Examples of the raw silicone rubber includes dimethyl silicone, methyl vinyl silicone, methyl phenyl vinyl silicone and the like.

The raw silicone rubber is not limited, but examples thereof will be shown by a trade name thereof. Examples of the dimethyl silicone rubber include "KE-76 (trade name)", which is commercially available from Shin-Etsu Chemical Co., Ltd.; "TS-959 (trade name)", which is commercially available from Toshiba Silicone Co., Ltd.; "Silastic 400 (trade name)" and "Silastic 401 (trade name)", which are commercially available from Dow Corning Co. (D.C.); "SE-76 (trade name)", which is commercially available from General Electric Co. (G.E.); "W-95 (trade name)", which is commercially available from Union Carbide Co. (U.C.C.); and the like. Examples of methyl vinyl silicone rubber include "KE-77 (trade name)", which is commercially available from Shin-Etsu Chemical Co., Ltd.; "TS-959B (trade name)", which is commercially available from Toshiba Silicone Co., Ltd.; "SH-430 (trade name)", which is commercially available from Toray Silicone Co., Ltd.; "Silastic 410 (trade name)" and "Silastic 430 (trade name)", which are commercially available from Dow Corning Co. (D.C.); "SE-31 (trade name)", which is commercially available from General Electric Co. (G.E.); "W-96 (trade name)", which is commercially available from Union Carbide Co. (U.C.C.); and the like. Examples of methyl phenyl vinyl silicone rubber include "KE-79 (trade name)", which is commercially available from Shin-Etsu Chemical Co., Ltd.; "Silastic 440 (trade name)", which is commercially available from Dow Corning Co. (D.C.); "W-97 (trade name)", which is commercially available from Union Carbide Co. (U.C.C.); and the like.

When a vulcanized molded article of only raw silicone rubber is used, tensile strength thereof tends to be low. Therefore the silicone rubber may comprise a filler in order to improve the strength of the vulcanized molded article of silicone rubber. As the filler, there are a reinforcable filler for reinforcing the silicone rubber and a non-reinforcable filler for extending the silicone rubber. It is required in all cases to select the filler, which has excellent heat resistance and does not deteriorate the performance of the silicone rubber at high temperature. Examples of the reinforcable fillers include a surface treated silica, high purity fumed silica, silica aerogel, precipitated silica and the like.

Examples of the non-reinforcable fillers include a calcined diatomaceous silica, precipitated calcium carbonate, ground silica, ground quartz, titanium oxide, zinc oxide and the like.

A method for vulcanizing the silicone rubber includes a method of using organic peroxide, fatty azo compound, radiation and the like, but organic peroxide is generally used as a vulcanizing agent. Examples of the organic peroxide include benzoyl peroxide, bis (2,4-dichlorobenzoyl) peroxide, dicumyl peroxide, di-t-butyl peroxide and the like. The amount of the vulcanizing agent is preferably from 0.2 to 8.0 parts by weight, based on 100 parts by weight of the base silicone rubber. When the amount of the vulcanizing agent is smaller than 0.2 parts by weight, the vulcanization is not perfectly conducted, and the hardness is low, which degrades the rebound characteristics. On the other hand, when the amount of the vulcanizing agent is larger than 8.0 parts by weight, the center is hard, and the spin amount is high, which reduces the flight distance.

The vulcanization of the silicone rubber may be heat vulcanizing type, which is conducted by heating, or room temperature vulcanizing type, which is conducted by leaving it at room temperature. The room temperature vulcanizing type silicone rubber is classified into one-component type and two-component type. The one-component type silicone rubber is filled in a cartridge or tube in a state of compounding the vulcanizing agent with the raw silicone rubber, and is vulcanized by condensation reaction when it is contacted with air. The two-component type silicone rubber is vulcanized by mixing the vulcanizing agent at the time of using.

The silicone rubber may be dimethyl silicone rubber, methyl vinyl silicone rubber and methyl phenyl vinyl silicone rubber as described above, but copolymer thereof may be used. Preferred is heat vulcanizing type silicone rubber, which is copolymer of dimethyl siloxane rubber as a main component and methyl vinyl siloxane as a small component, in view of rebound characteristics. Content of vinyl group in the silicone rubber is preferably 0.1 to 10 molar %, more preferably 0.15 to 0.8 molar %.

The silicone rubber may be mixed with polybutadiene rubber (BR), ethylene-propylene-diene monomer terpolymer rubber (EPDM), acrylonitrile butadiene rubber (NBR) acrylonitrile rubber, polynorbornene rubber and the like. In the vulcanized molded article, the amount of the silicone rubber is not less than 70 parts by weight, preferably not less than 80 parts by weight, based on 100 parts by weight of base rubber of the center. When the amount of the silicone rubber is smaller than 70 parts by weight, good retentivity of spin is not obtained.

When the center 1 is prepared by using the silicone rubber composition, the center is obtained by mixing 0.5 to 5 parts by weight of vulcanizing agent and a desired amount of weight adjuster, based on 100 parts by weight of the silicone rubber using a Banbury mixer or a mixing roll and by press molding and vulcanizing at 150 to 170° C. for 10 to 20 minutes. The vulcanizing agent and weight adjuster may be one, which has been conventionally used. However, as the weight adjuster, high specific gravity filler is used in order to accomplish high weight ratio of the rubber component in the center and low hardness of the center. Example of the weight adjuster includes barium sulfate, calcium carbonate, clay, silica and the like.

The intermediate layer 2 is then covered on the center 1 to form the core 4. A method of covering the center 1 with the intermediate layer 2 is not specifically limited, but may be conventional methods, which have been known to the art and used for forming the two-layer structured core of the golf balls. For example, there can be used a method comprising uniformly mixing the composition for the intermediate layer, coating on the center 1 into a concentric sphere, followed by pressure molding in a mold at 130 to 180° C. for 10 to 40 minutes; or a method comprising molding the composition for the intermediate layer into a semi-spherical half-shell in advance, covering the center 1 with the two half-shells, followed by pressure molding at 130 to 180° C. for 10 to 40 minutes.

In the golf ball of the present invention, it is desired for the intermediate layer 2 to have a thickness of 8.5 to 15.5 mm, preferably 9.0 to 15.0 mm, more preferably 9.5 to 14.5 mm. When the thickness of the intermediate layer 2 is smaller than 8.5 mm, the rebound characteristics of the resulting golf ball are degraded, which reduces the flight distance. On the other hand, when the thickness is larger than 15.5 mm, since the intermediate layer is formed from hard material, the shot feel of the resulting golf ball is hard and poor.

In the golf ball of the present invention, it is required for the intermediate layer 2 to have a surface hardness in Shore D hardness of 50 to 65, preferably 52 to 64, more preferably 54 to 63, most preferably 56 to 62. When the surface hardness of the intermediate layer 2 is lower than 50, the core is too soft, and it is difficult to adjust the hardness of the resulting golf ball to a proper range. On the other hand, when the hardness is higher than 65, the intermediate layer is too hard, and the shot feel is poor. In addition, the spin amount at the time of hitting is increased, which reduces the flight distance. The term "a hardness of the intermediate layer 2" as used herein, means the surface hardness of the core having a two-layered structure, which is formed by integrally press-molding the center and the intermediate layer.

In the golf ball of the present invention, the core 4 has a diameter of 37.5 to 42.2 mm, preferably 37.7 to 41.9 mm, more preferably 38.0 to 41.5 mm. When the diameter of the core is smaller than 37.5 mm, it is required to increase the thickness of the cover in order to adjust the diameter of the resulting golf ball to diameter conformed to the regulations for golf balls, and the shot feel is poor. On the other hand, when the diameter of the core is larger than 42.2 mm, the diameter of the resulting golf ball is too large, and air resistance on the fly is large, which reduces the flight distance.

In the golf ball of the present invention, it is desired for the core 4 to have a deformation amount when applying from an initial load of 98 N to a final load of 1275 N of 2.6 to 3.8 mm, preferably 2.8 to 3.6 mm, more preferably 3.0 to 3.4 mm. When the deformation amount of the core 4 is smaller than 2.6 mm, the deformation amount of the resulting golf ball at the time of hitting is small, and the spin amount is increased, which reduces the flight distance. In addition, the shot feel is hard and poor. On the other hand, when the deformation amount is larger than 3.8 mm, the core is too soft, and the rebound characteristics of the resulting golf ball are degraded, which reduces the flight distance. In addition, the durability is poor.

In the golf ball of the present invention, a material for the intermediate layer 2 is not limited as long as it has properties as described above, but it is desired for the intermediate layer 2 to be formed from a vulcanized molded article of a rubber composition mainly comprising polybutadiene rubber composition the same as used for the center 1. The polybutadiene rubber composition for the intermediate layer 2 may contain

- from 30 to 50 parts by weight, preferably from 32 to 48 parts by weight of a co-crosslinking agent,
- from 0.5 to 5 parts by weight, preferably from 0.7 to 4 parts by weight of an organic peroxide,
- from 4 to 20 parts by weight, preferably from 5 to 18 parts by weight of a filler and the like, based on 100 parts by weight of polybutadiene rubber.

The polybutadiene rubber compositions for the intermediate layer 2 of the golf ball of the present invention can optionally contain other components, which have been conventionally used for preparing the core of solid golf balls, such as organic sulfide compound, antioxidant and the like. If used, the amount of the other components is from 0.5 to 5.0 parts by weight, preferably 0.7 to 4.0 parts by weight, based on 100 parts by weight of the base rubber.

In the golf ball of the present invention, it is preferable that the center 1 and the intermediate layer 2 be formed from the polybutadiene rubber composition; and it is more preferable that the center 1 be formed from the silicone rubber composition and the intermediate layer 2 be formed from the polybutadiene rubber composition.

The cover 3 is then covered on the core 4. In the golf ball of the present invention, it is desired for the cover 3 to have a thickness of 0.5 to 2.5 mm, preferably 0.7 to 2.0 mm, more preferably 1.0 to 1.8 mm. When the thickness is smaller than 0.5 mm, the technical effects of hardening the cover are not sufficiently obtained, and the spin amount at the time of hitting is large, which reduces the flight distance. In addition, the launch angle when hit by a short iron club and the like is small, and the angle of drop is small. Therefore, it is difficult to stop the golf ball on the green, which degrades the controllability. On the other hand, when the thickness is larger than 2.5 mm, the shot feel is hard and poor.

In the golf ball of the present invention, it is required for the cover 3 to have a hardness in Shore D of 55 to 70, preferably 58 to 69, more preferably 61 to 68. When the cover hardness is lower than 55, the cover is too soft, and the spin amount at the time of hitting is increased. Therefore, the golf ball creates blown-up trajectory, which reduces the flight distance. On the other hand, when the cover hardness is higher than 70, the cover is too hard, and the impact force at the time of hitting is large, which degrades the shot feel. In addition, the durability is poor. The term "a hardness of the cover 3" as used herein refers to the hardness (slab hardness) measured using a sample of a heat and press molded sheets from the cover composition.

In the golf ball of the present invention, it is required for the cover 3 to have a flexural modulus of not less than 280 MPa. When the flexural modulus of the cover 3 is smaller than 280 MPa, the technical effects of improving the rebound characteristics accomplished by the presence of the cover are not sufficiently obtained, and the flight distance is not sufficiently improved. When the flexural modulus is too large, the cover is too hard, and the shot feel of the resulting golf ball is poor. Therefore, the flexural modulus of the cover 3 is within the range of preferably 280 to 600 MPa, more preferably 300 to 500 MPa.

The cover 3 of the present invention is formed from a cover composition mainly comprising thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, lithium ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8140, Surlyn 9120, Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene-based block copolymer and the like. Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 35481", "Hytrel 4047"); polyurethane-based thermoplastic elastomer, which is commercially available from Takeda Bardishe Co., Ltd. under the trade name of "Elastollan" (such as "Elastollan ET880"); and the like.

The diene-based block copolymer is a block copolymer or partially hydrogenated block copolymer having double bond derived from conjugated diene compound. The base block copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene-based block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers which are commercially available include the diene-based block copolymers, which are commercially available from Daicel Chemical Industries, Ltd. under the trade name of "Epofriend" (such as "Epofriend A1010"), the diene-based block copolymers, which are commercially available from Kuraray Co., Ltd. under the trade name of "Septon" (such as "Septon HG-252") and the like.

The amount of the thermoplastic elastomer or diene-based block copolymer is 1 to 60 parts by weight, preferably 1 to 35 parts by weight, based on 100 parts by weight of the base resin for the cover. When the amount is smaller than 1 part by weight, the technical effect of absorbing the impact force at the time of hitting accomplishing by using them is not sufficiently obtained. On the other hand, when the amount is larger than 60 parts by weight, the cover is too soft and the rebound characteristics are degraded, or the compatibility with the ionomer resin is degraded and the durability is degraded.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core with the two half-shells, followed by press molding at 130 to 170° C. for 1 to 5 minutes, or a method comprising injection molding the cover composition directly on the core, which is covered with the cover, to cover it.

At the time of molding the cover, many depressions called "dimples" are formed on the surface of the golf ball. The term "an area of the dimple" as used herein refers to the area enclosed in the periphery (edge) of the dimple when observing the central point of the golf ball from infinity, which is the area of plane. When the dimple is spherical, the area of the dimple S is determined by calculating from the following formula:

$$S=\pi(d/2)^2$$

wherein d is a diameter of the dimple. The ratio (Y) of the golf ball surface occupied by the dimple to the total surface area of the golf ball is determined by calculating a ratio of (the total of the area S of each dimple) to (the surface area of the-phantom sphere assuming that the golf ball is a true sphere having no dimples on the surface thereof).

It is desired for the ratio (Y) of the golf ball surface occupied by the dimple to the total surface area of the golf ball to be not less than 75%, preferably 78 to 88%, more preferably 80 to 87%. When the ratio (Y) is smaller than 75%, the hit golf ball creates blown-up trajectory, which reduces the flight distance. It is difficult to design the dimples such that the ratio (Y) of the golf ball surface occupied by the dimple to the total surface area of the golf ball is larger than 88%.

It is desired for the dimple to have a total number of not more than 320, preferably 210 to 320, more preferably 230 to 316, most preferably 240 to 312. When the total number of the dimples is larger than 320, it is difficult for each dimple to have a desired size while maintaining the ratio (Y) of not less than 75%. On the other hand, when the total number of the dimples is smaller than 210, it is difficult to design the dimples such that the ratio (Y) is not less than 75%.

It is desired for the maximum diameter of the dimple to be from 11 to 18%, preferably from 12 to 17%, more preferably from 13 to 16% of the diameter of the golf ball. When the maximum diameter of the dimple is smaller than 11% of the diameter of the golf ball, the technical effects accomplished by the presence of each dimple are not sufficiently obtained. On the other hand, when the maximum diameter of the dimple is larger than 18% of the diameter of the golf ball, it is difficult for the golf ball to have spherical shape, and the flight performance is poor. In addition, smooth rolling of the golf ball on putting is not sufficiently obtained.

It is desired for the dimple to have a diameter of 2.0 to 8.0 mm, preferably 3.0 to 7.0 mm. When the diameter of the dimple is smaller than 2.0 mm, an area of an opening of the dimple is too small, and the technical effects accomplished by the presence of the dimple are not sufficiently obtained. On the other hand, when the diameter of the dimple is larger than 8.0 mm, a number of the dimple arranged on the surface of the golf ball is small, and the technical effects accomplished by the presence of the dimple are not sufficiently obtained.

It is desired for the dimples to be of not less than 2 types, preferably 2 to 5 types, which have different diameter. When the dimples are of one type, that is, the dimples have all the same diameter, it is difficult to disturb an airflow around the golf ball on the fly, which degrades its flight performance. The ratio (Y) of the golf ball surface occupied by the dimple to the total surface area of the golf ball and the diameter of the dimple as used herein are determined by measuring at the surface of the resulting golf ball, and if paint is applied on the cover, they are determined by measuring at the surface of applied golf ball.

Furthermore, paint finishing or marking with a stamp may be optionally provided after the cover is molded for commercial purposes. The golf ball of the present invention is formed such that it has a diameter of 40 to 45 mm, preferably 42 to 44 mm. It is desired for the golf ball to have a diameter of 42.67 to 42.80 mm in view of the reduction of air resistance in accordance with USGA (United States Golf Association) rule. The golf ball of the present invention is formed such that it has a weight of 44 to 46 g, preferably 45.00 to 45.93 g.

EXAMPLES

The following Examples and Comparative Examples further illustrate the present invention in detail but are not to be construed to limit the scope of the present invention.

Production of Core (i) Production of Center

The rubber composition for the center having the formulation shown in Table 1 was mixed, and then vulcanized by press-molding at 160° C. for 20 minutes in the mold to obtain spherical center. The weight, diameter, central point hardness and surface hardness of the resulting center were measured, and the results are shown in the same Table.

(ii) Production of Two-layer Structured Core

The rubber composition for the intermediate layer having the formulation shown in Table 1 was mixed, and coated on the center produced in the step (i) into a concentric sphere, and then vulcanized by press-molding at 165° C. for 20 minutes in the mold to obtain two-layer structured core having a diameter of 40.0 mm and weight of 37.6 g. The thickness and surface hardness of the resulting intermediate layer were measured, and the results are shown in the same Table and Tables 3 to 4.

TABLE 1

| Core | A | B | C | D | E | F |
|---|---|---|---|---|---|---|
| Center composition (parts by weight) | | | | | | |
| BR-11 *1 | — | — | — | 100 | 100 | — |
| Zinc acrylate | — | — | — | 9 | 25 | — |
| Zinc oxide | — | — | — | 5 | 5 | — |
| Barium sulfate | — | — | — | 20.5 | 14.5 | — |
| Dicumyl peroxide | — | — | — | 0.8 | 0.8 | — |
| Diphenyl disulfide | — | — | — | 0.5 | 0.5 | — |
| KE530-U *2 | 100 | — | — | — | — | — |
| KE540-U *3 | — | 100 | — | — | — | 100 |
| KE1551-U *4 | — | — | 100 | — | — | — |
| C-4 *5 | 4 | 4 | 4 | — | — | 4 |
| Weight (g) | 1.0 | 2.0 | 4.2 | 4.2 | 4.2 | 2.0 |
| Diameter (mm) | 12.0 | 15.0 | 19.0 | 19.0 | 19.0 | 15.0 |
| Central point hardness (JIS-A) | 32 | 42 | 58 | 71 | 92 | 42 |
| Surface hardness (JIS-A) | 33 | 43 | 60 | 75 | 97 | 43 |
| Intermediate layer composition (parts by weight) | | | | | | |
| BR-11 *1 | 100 | 100 | 100 | 100 | 100 | 100 |
| Zinc acrylate | 37 | 41 | 44 | 44 | 44 | 28 |
| Zinc oxide | 5 | 5 | 5 | 5 | 5 | 5 |
| Barium sulfate | 9 | 7.5 | 5.5 | 5.5 | 5.5 | 12.5 |
| Dicumyl peroxide | 0.7 | 0.7 | 0.7 | 0.7 | 0.7 | 0.7 |
| Thickness (mm) | 14.0 | 12.5 | 10.5 | 10.5 | 10.5 | 12.5 |
| Surface hardness (Shore D) | 58 | 61 | 63 | 63 | 63 | 44 |

*1: High-cis Polybutadiene rubber, commercially available from JSR Co., Ltd. under the trade name of "BR-11" (Content of 1,4-cis-polybutadiene: 96%)
*2: KE530-U (trade name), silicone compound commercially available from Shin-Etsu Chemical Co., Ltd.
*3: KE540-U (trade name), silicone compound commercially available from Shin-Etsu Chemical Co., Ltd.
*4: KE1551-U (trade name), silicone compound commercially available from Shin-Etsu Chemical Co., Ltd.
*5: C-4 (trade name), vulcanization accelerator commercially available from Shin-Etsu Chemical Co., Ltd.

Preparation of Compositions for Cover

The formulation materials for the cover showed in Table 2 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 160 to 260° C. at the die position of the extruder. The Shore D hardness and flexural modulus of the resulting cover composition were measured, and the results are shown in the same Table.

TABLE 2

| Cover composition | (parts by weight) a | b | c | d |
|---|---|---|---|---|
| Hi-milan 1605 *6 | 20 | — | 60 | — |
| Hi-milan 1706 *7 | 20 | — | 40 | — |
| Hi-milan 1855 *8 | 60 | 10 | — | — |
| Surlyn 9120 *9 | — | — | — | 50 |
| Surlyn 8140 *10 | — | — | — | 50 |
| Surlyn 8945 *11 | — | 46 | — | — |
| Surlyn 9945 *12 | — | 37 | — | — |
| Pebax 2533 *13 | — | 5 | — | — |
| Epofriend A1010 *14 | — | 2 | — | — |
| Titanium dioxide | 4 | 4 | 4 | 4 |
| Cover hardness (Shore D) | 58 | 67 | 63 | 67 |
| Flexural modulus (MPa) | 240 | 280 | 300 | 380 |

*6: Hi-milan 1605 (trade name), ethylene-methacrylic acid copolymer ionomer resin obtained by neutralizing with sodium ion, manufactured by Du Pont-Mitsui Polychemicals Co., Ltd.
*7: Hi-milan 1706 (trade name), ethylene-methacrylic acid copolymer ionomer resin obtained by neutralizing with zinc ion, manufactured by Du Pont-Mitsui Polychemicals Co., Ltd.
*8: Hi-milan 1855 (trade name), ethylene-methacrylic acid-acrylic acid ester terpolymer ionomer resin obtained by neutralizing with zinc ion, manufactured by Du Pont-Mitsui Polychemicals Co., Ltd.
*9: Surlyn 9120 (trade name), ethylene-methacrylic acid copolymer ionomer resin obtained by neutralizing with zinc ion, manufactured by Du Pont Co., Shore D hardness: 69
*10: Surlyn 8140 (trade name), ethylene-methacrylic acid copolymer ionomer resin obtained by neutralizing with sodium ion, manufactured by Du Pont Co.
*11: Surlyn 8945 (trade name), ethylene-methacrylic acid copolymer ionomer resin obtained by neutralizing with sodium ion, manufactured by Du Pont Co., Shore D hardness: 65
*12: Surlyn 9945 (trade name), ethylene-methacrylic acid copolymer ionomer resin obtained by neutralizing with zinc ion, manufactured by Du Pont Co.
*13: Pebax 2533 (trade name), polyether amide-based thermoplastic elastomer, which is commercially available from Atochem Co.
*14: Epofriend A1010 (trade name), styrene-butadiene styrene (SBS) block copolymer with epoxy groups, manufactured by Daicel Chemical Industries, Ltd.

Examples 1 to 5 and Comparative Examples 1 to 3

The resulting composition for the cover was covered on the resulting two-layer structured core by injection molding to form a cover layer having the dimples shown in Table 7 on the surface thereof and a thickness of 1.4 mm. The hardness of the resulting cover was measured, and the results are shown in Tables 3 and 4. Then, clear paint was applied on the surface to obtain golf ball having a diameter of 42.8 mm and weight of 45.3 g. The flight performance (initial velocity, spin amount, launch angle and flight distance) and shot feel of the resulting golf balls were measured or evaluated. The results are shown in Tables 5 and 6. The test methods are as follows.

(Test Method)

(1) Hardness (i) Hardness of the Center

A JIS-A hardness was measured at the central point and surface of the center. The surface hardness of the center was determined by measuring a hardness at the surface of the resulting center. The central point hardness of the center was determined by cutting the resulting center into two equal parts and then measuring a hardness at its central point in section. The JIS-A hardness was measured with a JIS-A hardness meter according to JIS K 6301.

(ii) Hardness of the Intermediate Layer

The surface hardness of the intermediate layer was determined by measuring a Shore D hardness at the surface of the resulting two-layer structured core obtained by forming the intermediate layer on the center. The Shore D hardness was measured by using an automatic rubber hardness tester (type LA1), which is commercially available from Kobunshi Keiki Co., Ltd., with a Shore D hardness meter according to ASTM D 2240.

(iii) Hardness of the Cover (Slab Hardness)

The hardness of the cover was determined by measuring a Shore D hardness, using a sample of a stack of the three or more heat and press molded sheets having a thickness of about 2 mm from the cover composition, which had been stored at 23° C. for 2 weeks. The Shore D hardness was measured by using an automatic rubber hardness tester (type LA1), which is commercially available from Kobunshi Keiki Co., Ltd., with a Shore D hardness meter according to ASTM D 2240.

(2) Flexural Modulus of Cover

The flexural modulus was determined according to JIS K 7106, using a sample of a heat and press molded sheet having a thickness of about 2 mm from each cover composition, which had been stored at 23° C. for 2 weeks.

(3) Flight Performance

After a No. 1 wood club (a driver, W#1; "XXIO" loft angle=11 degrees, R shaft, manufactured by Sumitomo Rubber Industries, Ltd.) having metal head was mounted to a swing robot manufactured by Golf Laboratory Co. and a golf ball was hit at head speed of 40 m/sec, the initial velocity, spin amount (backspin) immediately after hitting, launch angle and flight distance were measured. As the flight distance, total that is a distance to the stop point of the hit golf ball was measured. The measurement was conducted 12 times (n=12) for each golf ball, and the average is shown as the result of the golf ball.

(4) Shot Feel (i) Shot Feel (1)

The shot feel of the golf ball is evaluated by 10 golfers according to a practical hitting test using a No. 1 wood club (W#1, a driver) having a metal head. The evaluation criteria are as follows. The results shown in the Tables below are based on the fact that the most golfers evaluated with the same criterion about shot feel.

Evaluation Criteria (Impact Force)

○: The golfers felt that the golf ball has good shot feel such that the impact force at the time of hitting is small.

Δ: The golfers felt that the golf ball has fairly good shot feel.

x: The golfers felt that the golf ball has poor shot feel such that the impact force at the time of hitting is large.

(ii) Shot Feel (2)

The shot feel of the golf ball is evaluated by 10 golfers according to a practical hitting test using a No. 1 wood club (W#1, a driver) having a metal head. The evaluation criteria are as follows. The results shown in the Tables below are based on the fact that the most golfers evaluated with the same criterion about shot feel.

Evaluation criteria (Rebound characteristics)

○: The golfers felt that the golf ball has good shot feel such that the rebound characteristics are good.

Δ: The golfers felt that the golf ball has fairly good shot feel.

x: The golfers felt that the golf ball has heavy and poor shot feel such that the rebound characteristics are poor.

(Test Results)

TABLE 3

| Test item | Example No. 1 | 2 | 3 | 4 | 5 |
|---|---|---|---|---|---|
| Core composition (Center) | A | B | C | C | D |
| Weight (g) | 1.0 | 2.0 | 4.2 | 4.2 | 4.2 |
| Diameter (mm) | 12.0 | 15.0 | 19.0 | 19.0 | 19.0 |
| Central point hardness (Shore A) | 32 | 42 | 58 | 58 | 71 |
| Surface hardness (Shore A) | 33 | 43 | 60 | 60 | 75 |
| (Intermediate layer) | | | | | |
| Thickness (mm) | 14.0 | 12.5 | 10.5 | 10.5 | 10.5 |
| Surface hardness (Shore D) | 58 | 61 | 63 | 63 | 63 |
| (Cover) | | | | | |
| Composition | b | c | d | d | d |
| Hardness (Shore D) | 67 | 63 | 67 | 67 | 67 |
| Flexural modulus (MPa) | 280 | 300 | 380 | 380 | 380 |
| Type of dimple | (1) | (2) | (1) | (3) | (1) |

TABLE 4

| Test item | Comparative Example 1 | 2 | 3 |
|---|---|---|---|
| Core composition (Center) | E | F | B |
| Weight (g) | 4.2 | 2.0 | 2.0 |
| Diameter (mm) | 19.0 | 15.0 | 15.0 |
| Central point hardness (Shore A) | 92 | 42 | 42 |
| Surface hardness (Shore A) | 97 | 43 | 43 |
| (Intermediate layer) | | | |
| Thickness (mm) | 10.5 | 12.5 | 12.5 |
| Surface hardness (Shore D) | 63 | 44 | 61 |
| Cover | | | |
| Composition | d | d | a |
| Hardness (Shore D) | 67 | 67 | 58 |
| Flexural modulus (MPa) | 380 | 380 | 240 |
| Type of dimple | (1) | (1) | (1) |

TABLE 5

| Test item | Example No. 1 | 2 | 3 | 4 | 5 |
|---|---|---|---|---|---|
| (Golf ball) Flight performance; W#1, 40 m/sec | | | | | |
| Initial velocity (m/sec) | 57.6 | 57.5 | 57.6 | 57.6 | 57.7 |
| Spin amount (rpm) | 2600 | 2550 | 2470 | 2470 | 2580 |
| Launch angle (degree) | 13.0 | 13.2 | 13.8 | 13.8 | 13.2 |
| Total (m) | 197.5 | 197.0 | 198.5 | 195.5 | 197.5 |
| Shot feel (1) Impact force | ○ | ○ | ○ | ○ | ○ |
| Shot feel (2) Rebound | ○ | ○ | ○ | ○ | ○ |

TABLE 6

| Test item | Comparative Example No. 1 | 2 | 3 |
|---|---|---|---|
| (Golf ball) Flight performance; W#1, 40 m/sec | | | |
| Initial velocity (m/sec) | 57.8 | 57.0 | 57.2 |
| Spin amount (rpm) | 2820 | 2650 | 2710 |
| Launch angle (degree) | 12.2 | 12.7 | 12.5 |
| Total (m) | 194.5 | 191.5 | 194.5 |
| Shot feel (1) Impact force | x | ○ | ○ |
| Shot feel (2) Rebound | ○ | x | x |

TABLE 7

| Type | N | D (mm) | Depth (mm) | Volume ($mm^3$) | Ratio of D (%) | Ratio of S (%) | Total volume ($mm^3$) | Total number |
|---|---|---|---|---|---|---|---|---|
| (1) | 18 | 5.60 | 0.131 | 1.614 | 13.1 | 84.68 | 310 | 294 |
| | 102 | 5.10 | 0.128 | 1.307 | 11.9 | | | |
| | 24 | 4.85 | 0.128 | 1.185 | 11.3 | | | |
| | 18 | 4.50 | 0.127 | 1.011 | 10.5 | | | |
| | 72 | 4.25 | 0.126 | 0.894 | 9.9 | | | |
| | 36 | 3.90 | 0.127 | 0.761 | 9.1 | | | |
| | 24 | 2.75 | 0.127 | 0.379 | 6.4 | | | |
| (2) | 80 | 6.20 | 0.134 | 2.02 | 14.5 | 81.34 | 310 | 288 |
| | 88 | 4.30 | 0.132 | 0.958 | 10.0 | | | |
| | 80 | 3.50 | 0.132 | 0.634 | 8.2 | | | |
| | 40 | 2.50 | 0.132 | 0.324 | 5.8 | | | |
| (3) | 132 | 4.10 | 0.141 | 0.931 | 9.6 | 79.73 | 310 | 432 |
| | 180 | 3.55 | 0.132 | 0.654 | 8.3 | | | |
| | 60 | 3.40 | 0.132 | 0.601 | 7.9 | | | |
| | 60 | 3.25 | 0.133 | 0.553 | 7.6 | | | |

N: Number
D: Diameter
Ratio of D: Ratio of the maximum diameter of the dimple to the diameter of the golf ball
Ratio of S: Ratio of the golf ball surface area occupied by the dimple to the total surface area of the golf ball As is apparent from Tables 3 to 7, the three-piece solid golf balls of the present invention of Examples 1 to 5 have good shot feel, and long flight distance by accomplishing low spin amount and high launch angle when hit by a driver, compared with the conventional golf balls of Comparative Examples 1 to 3.

On the other hand, in the golf ball of Comparative Example 1, since the hardness of the center is high, the spin amount is large and the launch angle is small, when hit by a driver, which reduces the flight distance. In addition, the shot feel is poor such that the impact force at the time of hitting is large.

In the golf ball of Comparative Example 2, since the surface hardness of the intermediate layer is low, the spin amount is large and the initial velocity is small when hit by a driver, which reduces the flight distance. In addition, the shot feel is heavy and poor such that the rebound characteristics are poor.

In the golf ball of Comparative Example 3, since the flexural modulus of the cover is low, the spin amount when hit by a driver is large, which reduces the flight distance. In addition, the shot feel is heavy and poor such that the rebound characteristics are poor.

What is claimed is:

1. A three-piece solid golf ball comprising a core composed of a center and an intermediate layer formed on the center, and a cover covering the core and having many dimples on the surface thereof wherein the center has a diameter of 12 to 19 mm and a central point hardness in JIS-A hardness of 32 to 71, the intermediate layer has a surface hardness in Shore D hardness of 50 to 65, the cover has a Shore D hardness of 55 to 70, a flexural modulus of not less than 280 MPa and a thickness of 0.5 to 2.5 mm;

at least portion of the dimples has a maximum diameter of from 13 to 16% of the diameter of the golf ball, a total number of the dimples is 240–312, and a ratio of the golf ball surface area occupied by the dimples to the total surface area of the golf ball is 78 to 88%.

2. The three-piece solid golf ball according to claim 1, wherein the center and intermediate layer are formed from a vulcanized molded article of a polybutadiene rubber composition.

3. The three-piece solid golf ball according to claim 1, wherein the center is formed from a vulcanized molded article of a silicone rubber composition, and the intermediate layer is formed from a vulcanized molded article of a polybutadiene rubber composition.

4. The three-piece solid golf ball according to claim 1, wherein the cover is formed from a cover compositior mainlycomprising ionomer resin as a base resin.

5. The three-piece solid golf ball according to claim 1, wherein the center has a diameter of 14 to 16 mm.

6. The three-piece solid golf ball according to claim 1, wherein the intermediate layer has a surface hardness in Shore D hardness of 56 to 62.

7. The three-piece solid, golf ball according to claim 1, wherein the cover has a Shore D hardness of 61 to 68, a flexural modulus of 300 to 500 MPa and a thickness of 1.0 to 1.8 mm.

8. A three-piece solid golf ball comprising, a core composed of a center and an intermediate layer formed on the center, and a cover covering the core and having many dimples on the surface thereof, wherein the center has a central point hardness in JIS-A hardness of 32 to 71, the intermediate layer has a surface hardness in Shore D hardness of 50 to 65, the cover has a Shore D hardness of 55 to 70, a flexural modulus of not less than 280 MPa and a thickness of 0.5 to 2.5 mm; and at least a portion of the dimples has a maximum diameter of from 13 to 16% of the diameter of the golf ball, a total number of the dimples is 240–312, and a ratio of the golf ball surface area occupied by the dimples to the total surface area of the golf ball is 78 to 88%.

9. A three-piece solid golf ball comprising a core composed of a center and an intermediate layer formed on the center, and a cover covering the core and having many dimples on the surface thereof wherein the center has a central point hardness in JIS-A hardness of 32 to 71, the intermediate layer has a surface hardness in Shore D hardness of 50 to 65, the cover has a Shore D hardness of 55 to 70, a fexural modulus of not less than 280 MPa and a thickness of 0.5 to 2.5 mm; and at least a portion of the dimples has a maximum diameter of from 13 to 16% of the diameter of the golf ball, and a ratio of the golf ball surface area occupied by the dimples to the total surface area of the golf ball is 80 to 87%.

* * * * *